US005711759A

United States Patent [19]

Smith et al.

[11] Patent Number: 5,711,759

[45] Date of Patent: Jan. 27, 1998

[54] ORAL HYGIENE DEVICE

[76] Inventors: Jennifer Maria Smith; Steven Ernest Smith, both of 31843 Oak Ridge Pkwy., Bulverde, Tex. 78163

[21] Appl. No.: 233,128

[22] Filed: Apr. 26, 1994

[51] Int. Cl.[6] ..... A61H 13/00

[52] U.S. Cl. ..... 601/139; 606/234

[58] Field of Search ..... 15/110, 161.1, 15/167.2; 601/139, 162; D24/194; 606/234, 235, 236; 433/141, 142, 215, 216, 229

[56] References Cited

U.S. PATENT DOCUMENTS

| | | | |
|---|---|---|---|
| D. 87,240 | 6/1932 | Podell | D24/194 |
| D. 170,051 | 7/1953 | Colin | D24/194 |
| D. 219,631 | 12/1970 | Bartels et al. | D24/194 |
| D. 338,732 | 8/1993 | Maradey-Collazo | D24/194 |
| 757,907 | 4/1904 | Fritz | 601/162 |
| 1,408,520 | 3/1922 | Larsen | 601/162 X |
| 1,605,456 | 11/1926 | Wortha | 601/162 X |
| 1,660,095 | 2/1928 | Schiele | 601/139 |
| 1,840,484 | 1/1932 | Brown | 601/139 X |
| 2,067,069 | 7/1937 | Sakakibara | 601/139 |
| 2,124,647 | 7/1938 | Bauler | 15/167.1 |
| 3,363,630 | 1/1968 | Hires | 606/234 |
| 3,669,117 | 6/1972 | Herbst | 15/110 |
| 4,115,893 | 9/1978 | Nakato et al. | 15/110 |
| 4,621,387 | 11/1986 | Noser | 15/167.1 |
| 4,819,641 | 4/1989 | Russell et al. | 606/234 |
| 5,048,143 | 9/1991 | Carroll | 15/167.1 X |
| 5,291,878 | 3/1994 | Lombardo et al. | 15/167.2 X |

*Primary Examiner*—Nicholas D. Lucchesi
*Attorney, Agent, or Firm*—Rapkin, Gitlin & Moser

[57] ABSTRACT

An oral hygiene device for use by infants, toddlers and small children as an effective tool for soothing and strengthening the gums and, when the new teeth begin to grow in, as an implement employed to keep the teeth clean and maintain both the gums and the teeth in a healthy condition, comprising a handle member, which is symmetrically oriented about a longitudinal axis, a head member, a nodule support surface and a plurality of nodules of varying heights and thicknesses supported by and extending from the nodule support surface, and a flange member mounted at the interface of the handle member and the head member. The head member and the nodule support surface are oriented longitudinally in a direction generally in alignment with the longitudinal axis of the handle member.

20 Claims, 2 Drawing Sheets

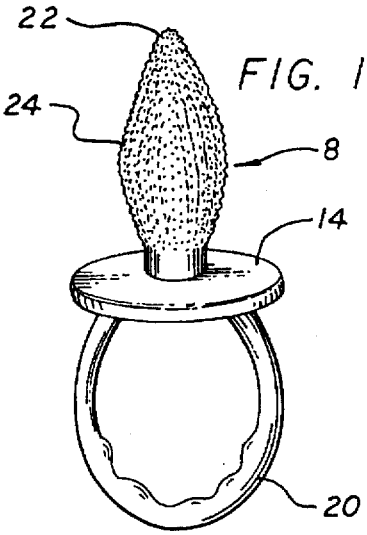
FIG. 1
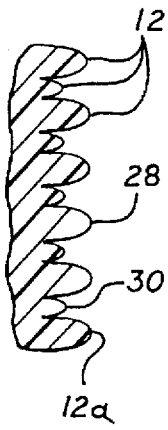
FIG. 3
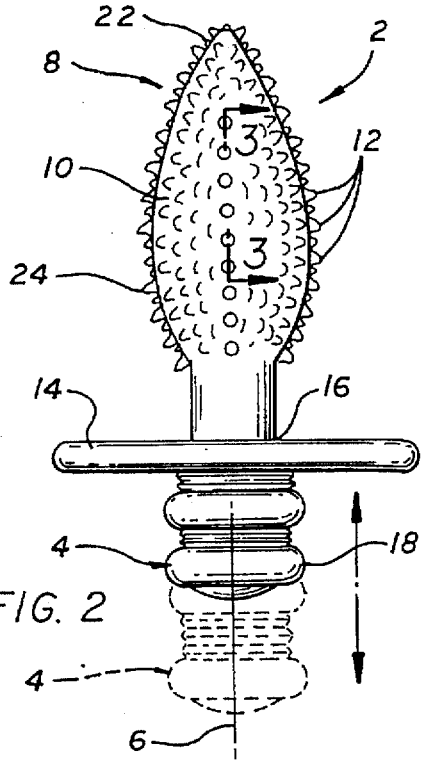
FIG. 2
FIG. 5
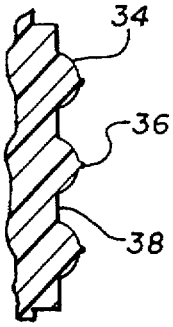
FIG. 4
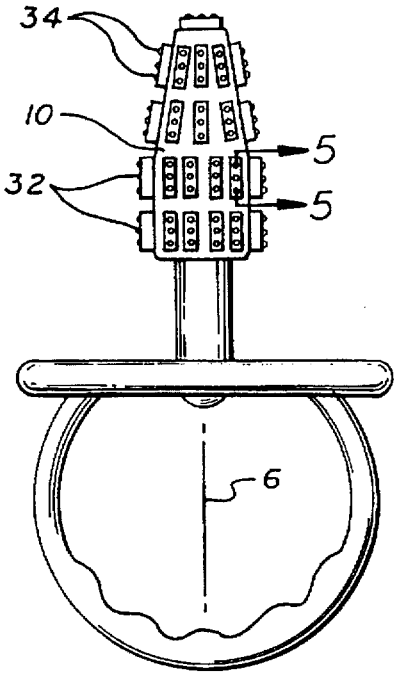
FIG. 7
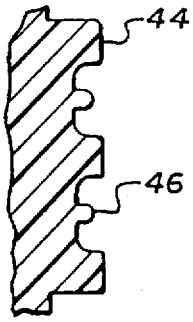
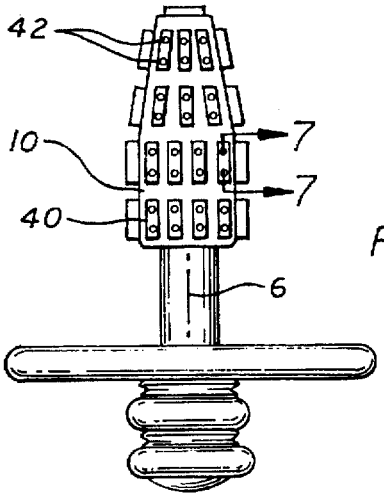
FIG. 6

FIG. 8
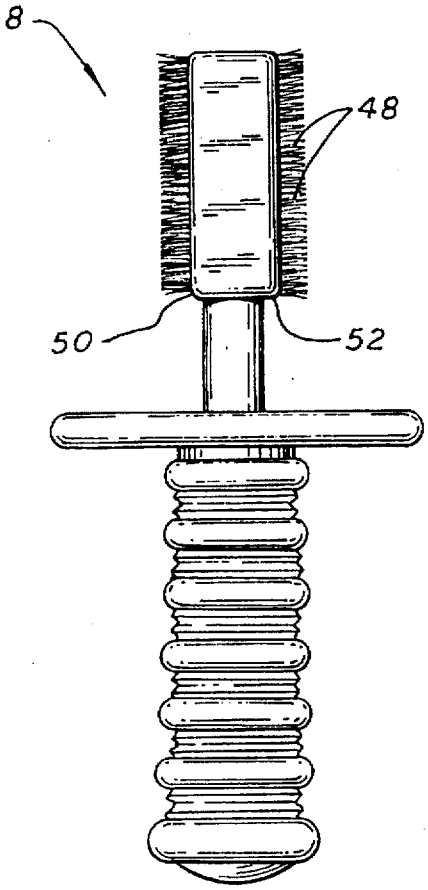
FIG. 10
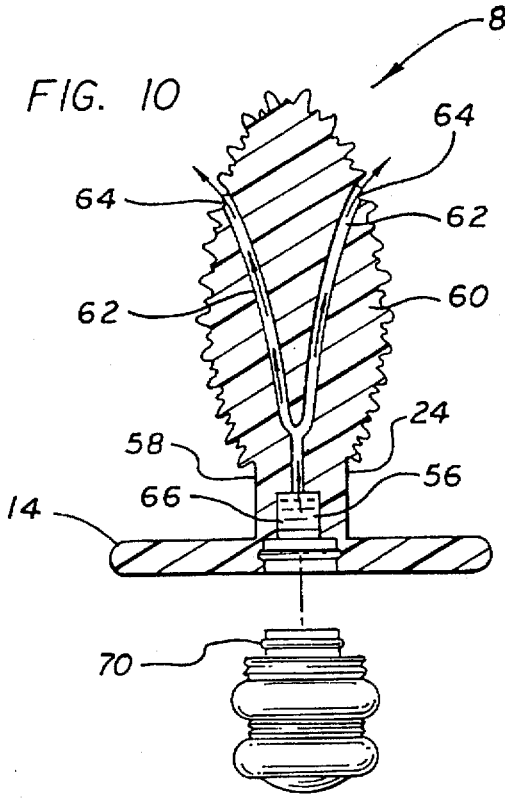
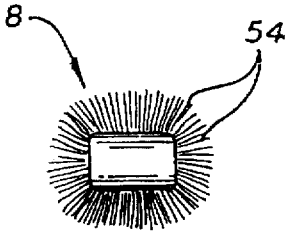
FIG. 9
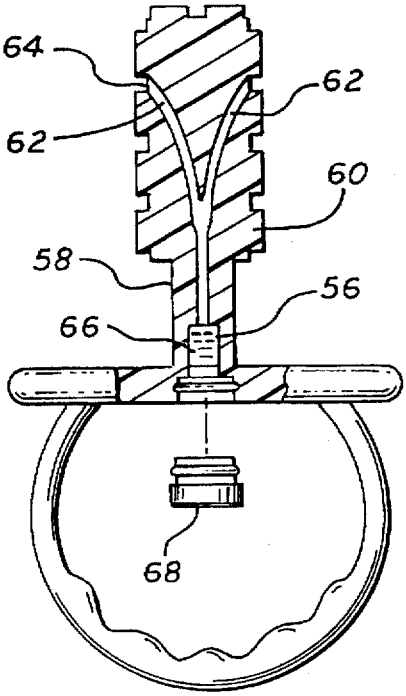
FIG. 11

ORAL HYGIENE DEVICE

BACKGROUND OF THE INVENTION

1. Field of the Invention

The invention relates generally to the field of oral hygiene and, more particularly to a new and improved implement suitable for use in brushing the teeth and massaging and maintaining the healthy condition of the gums of infants, toddlers and small children.

2. Description of the Prior Art

Proper dental care is extremely important from the beginning of a person's life through adulthood. Young children, adolescents and adults are fully capable of maintaining healthy teeth and gums by employing a daily regimen of proper brushing and flossing. Infants and toddlers, for obvious reasons, are not as capable. They not only lack the understanding of the objective of healthy gums and teeth and the discipline necessary to achieve this objective, they also lack the manual dexterity in their hands necessary to effectively manipulate a gum massaging or teeth cleaning implement inside their mouths.

The prior art is replete with all kinds of effective teeth cleaning and gum massaging devices that may be employed by people of almost any age. In this regard, there is, of course, the conventional tooth brush intended for use by children usually over three years of age, teens and adults, which comprises several rows of upstanding bristles mounted at the end of an extended handle. Teething devices, such as the conventional pacifier designed to simulate a mother's nipple, are also popular products. However, the toothbrush, because of its design, can be dangerous for an infant or toddler to use and the pacifier does nothing really to produce strong and healthy gums or clean teeth. A wide variety of other devices used for these same or related purposes are disclosed and claimed in the following U.S. Pat. Nos: 2,665,693 to Pecora; 3,669,117 to Herbts; 4,115,893 to Nakata et al.; 4,288,883 to Dolinsky; 4,654,921 to Dinner; 5,048,143 to Carroll and 5,284,490 to Green.

The oral hygiene device of the present invention attempts to overcome the many drawbacks associated with these existing and other prior art devices by providing an implement that is easily usable by an infant, toddler or small child (usually under 3 years of age) as an effective and extremely safe tool for learning the proper technique for massaging and soothing the gums and cleaning the teeth to maintain both in a healthy condition.

SUMMARY OF THE INVENTION

The present invention provides an oral hygiene device for use by infants, toddlers and small children as an effective tool for soothing and strengthening the gums and, when the new teeth begin to grow in, as an implement employed to keep the teeth clean and maintain both the gums and the teeth in a healthy condition.

To achieve this, the present invention provides a device for use by infants, toddlers and small children comprising a handle member, which is symmetrically oriented about a longitudinal axis, a head member, which includes a forward section, a mid-section and a back section, a nodule support surface, a plurality of nodules of varying heights and thicknesses supported by and extending from the nodule support surface, and a flange member mounted at the interface of the handle member and the head member. The head member and the nodule support surface are oriented longitudinally in a direction generally in alignment with the longitudinal axis of the handle member. The forward section of the head member has a shape that is slightly elongated and tapered relative to the size and shape of the mid-section and the back section. For reasons of safety and convenience, the handle member can also be collapsible and expandable in an accordion-like manner. An alternative resilient annular or ring shape handle, which is easy for an infant and child to grasp, may also be provided. The head member may also be rectangular in shape and include an elongated tapered portion at the forward end.

The head member will support nodules of varying shapes, heights and thicknesses. These nodules may be in the form of a plurality of individual projections neatly aligned in a row or in the form of groupings of rectangular shape nodules with several upstanding projections thereon arranged in rows or in some other appropriate fashion upon one or more of the various surfaces of the head member. Certain embodiments of the invention will also include a fluid reservoir inside a portion of the head member for feeding fluid passages to communicate fluid to various corresponding fluid ports formed in the surface of the head member. The device is an improvement over the prior art and eliminates the disadvantages attendant to these earlier devices.

Accordingly, it is an object of the present invention to provide an improved oral hygiene device for use by infants, toddlers and young children that serves as an effective and safe tool for developing proper hygiene skills by learning techniques for properly massaging and soothing the gums and cleaning the teeth to maintain both in a healthy condition.

It is a further object of the present invention to provide an improved oral hygiene device that can easily be manipulated in virtually all areas of an infant's mouth to achieve an effective and safe massaging and soothing of the gums and cleansing of the teeth.

It is yet a further object of the present invention to provide an improved oral hygiene device that can combine to serve both as a pacifier and a device for addressing and soothing the pain and discomfort that an infant normally experiences during the teething stage.

It is yet a further object of the present invention to provide an improved oral hygiene device that employs a system for conveying fluid of an appropriate temperature to the teething infant's mouth to soothe and strengthen the gums.

It is yet a further object of the present invention to provide an improved oral hygiene device that employs a system for conveying fluoride or some other suitable liquid to the infant's, toddler's or small child's teeth to provide greater protection from tooth decay.

It is yet a further object of the present invention to provide an improved oral hygiene device that is designed to reach all the areas inside the child's mouth, particularly the usually hard to reach areas at the back of the mouth.

It is yet a further object of the present invention to provide an improved oral hygiene device that includes a component which acts as a shield to guard against injury and trauma resulting from the inadvertent entry of the entire device into the child's mouth.

It is yet a further object of the present invention to provide an improved oral hygiene device that includes safety handles that are resilient and easy for the infant, toddler and small child to grip.

It is yet a further object of the present invention to provide an improved oral hygiene devices that includes an easy to grasp safety handle that is expandable and collapsible in an accordion-like manner.

It is yet a further object of the present invention to provide an improved oral hygiene device that helps to develop the child's sensory and motor skills.

It is yet a further object of the present invention to provide an improved oral hygiene device that prevents the build-up of plaque in the child's mouth at an early age.

It is yet a further object of the present invention to provide an improved oral hygiene device that is designed to inhibit and, at best, preclude, the infant, toddler and small child from intentionally or inadvertently biting off or separating one or more of the nodules from the nodule support surface.

It is still another object of the present invention to provide an improved oral hygiene device that is easy and cost effective to manufacture.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 1 is a perspective view of one embodiment of the device in accordance with the present invention.

FIG. 2 is a perspective view of the device in accordance with the present invention shown with the handle portion extended (in phantom) and contracted in an accordion-like manner.

FIG. 3 is a cross-sectional view of a grouping of nodules taken along line 3—3 of FIG. 2.

FIG. 4 is a perspective view of a second embodiment of the device in accordance with the present invention.

FIG. 5 is a cross-sectional view of a nodule component taken along line 5—5 of FIG. 4.

FIG. 6 is a side elevational view of a third embodiment of the device in accordance with the present invention.

FIG. 7 is a cross-sectional view of a nodule component taken along line 7—7 of FIG. 6.

FIG. 8 is a perspective view of a fourth embodiment of the device in accordance with the present invention.

FIG. 9 is a front perspective view of the device shown in FIG. 8 with bristles projecting from all sides of the head component.

FIG. 10 is a perspective view of a fifth embodiment of the device in accordance with the present invention which incorporates the liquid flow system.

FIG. 11 is a perspective view of a sixth embodiment of the device in accordance with the present invention which incorporates the liquid flow system.

DETAILED DESCRIPTION OF THE PREFERRED EMBODIMENT

Oral hygiene device 2, as shown in FIG. 2, comprises a handle member 4, which is symmetrically oriented about a longitudinal handle axis 6, a head member 8, which includes a nodule support surface 10, a plurality of nodules 12 that extend from and are supported by the nodule support surface 10, and an abutment flange 14 mounted at the point of interface 16 between the head member 8 and the handle member 4. Handle member 4 may come in various sizes and shapes. However, two versions are preferable over other possibilities and include a rod-like handle member embodiment 18 that is symmetrically oriented about a certain longitudinal axis and is expandable and collapsible in an accordion-like manner, and a ring or annular shape handle member embodiment 20. Both are easy for an infant, toddler or young child to grasp and include safety features, such as the collapsible handle that helps to prevent the oral hygiene device 2, in its entirety, from inadvertently entering the child's mouth and, thereby, causing severe and possibly permanent injury. As with the other components that comprise the device of the present invention, the handle member 4 is normally fabricated of rubber or some other type of suitable resilient natural or synthetic material.

Head member 8 can either be oval or rectangular in shape with the front end 22 usually elongated and tapered relative to the size and shape of the back end 24 to enable that portion of the head member 8 to extend safely into the back areas of the child's mouth that are usually difficult to reach.

The flange 14 is usually round in shape, though oval or rectangular shapes are also desirable and can be just as effective. The flange 14 encompasses an area that is sufficiently larger than an infant's or child's fully opened mouth to preclude the device in its entirety from inadvertently entering the mouth where it could cause abrasions to the inside of the mouth or throat or choke or otherwise severely injure the child.

The head member 8 and the nodule support surface 10, which extend longitudinally in a direction generally in alignment with the handle axis 6, support a plurality of fixed nodules 12 that are designed to vary in height, thickness and shape according to their respective purposes. Accordingly, FIGS. 1 and 2 depict one embodiment of these nodules and include a plurality of nodules 12 that are disposed linearly upon the nodule support surface 10 in a direction generally in alignment with the handle axis 6. Nodules 12 vary in height and are arranged upon the nodule support surface 10 according to height in an alternating sequence. Thus, the taller nodule 28 is arranged adjacent to a smaller nodule 30, which, in turn, is fixed alongside another taller nodule 28, and so on. This sequence is repeated along the entire nodule support surface 10. Nodules 12, despite their respective size, are in the shape of an inverted "V" with the top portion or apex 12*a* being rounded a bit to provide a more comfortable and soothing surface for engaging the child's gums and teeth.

FIG. 4 depicts a second alternate embodiment of the nodules employed in combination with the present invention. Nodules 32, which extend from the nodule support surface 10, are rectangular in shape and are arranged linearly along the nodule support surface 10 in a direction generally in alignment with the longitudinal handle axis 6. Mounted upon each nodule 32 are a plurality of annular projections 34 with each including a corresponding nipple-like projection 36 formed along the upper surface 38 of the nodule 32.

FIG. 7 depicts a third alternative embodiment comprising rectangular shape nodules 40, which, similar to the one just previously described, also extend outwardly from the nodule support surface 10. Nodules 40 are arranged linearly along the nodule support surface 10 in a direction generally in alignment with the longitudinal handle axis 6. Each nodule 40 includes a plurality of smaller, generally rectangular projections 42, which alternate in size. The tall projections 44 are typically wider than the small projections 46 and have rounded corners. The small projections 46 also include a fully rounded top surface.

The rectangular nodules 40, as shown in FIGS. 4 and 7, for example, are intentionally separated from one another by only a small pro-determined distance to preclude the child from easily wedging his or her teeth in between and biting into or underneath the nodule 40 and separating it from the nodule support surface 10. The same applies to the individual rectangular projections 42, which are positioned closely enough to one another to prevent them from separating, yet far enough away from each other to enable the child to effectively manipulate them upon the gums and teeth to achieve their intended objective.

Another alternative embodiment of the present invention includes the device shown in FIG. 8, which, instead of nodules, contains bristles 48 extending from opposite surfaces 50, 52 of the head member 8. This device is intended principally for young children in the 2 to 3 year old range with its chief objective being to act as a tool to teach the child the fundamentals of teeth cleaning using an actual brush-like implement in the process. Because the teeth are so new and the gums surrounding them may be tender, it is extremely important for the bristles 48 to be as resilient and soft as possible to prevent discomfort and possible injury to this area. Yet, the child has the means and opportunity to begin experimenting at a very young age with the idea of teeth maintenance and using an actual brush to perform the cleaning.

As shown in FIG. 9, the head member 8 can also include bristles 54 extending from all four sides making it easier for the child to have a more complete brushing experience no matter how the head member 8 is manipulated inside the child's mouth.

Another embodiment of the present invention includes a liquid flow system incorporated into the head member 8 of any of the embodiments shown in FIGS. 1, 2, 4, 7 and 8. Using FIG. 10 as an example, the system includes a fluid filled reservoir 56 housed within the back end 24 or the bridge portion 58 of the device that joins the head member 8 to the abutment flange 14. Extending from the reservoir 56 into the inside portion 60 of the head member 8 are a plurality of fluid passages 62 that terrains to at corresponding fluid ports 64 formed in the nodule support surface 10 of head member 8. In its application, as the child's gums or teeth press down upon the area containing the reservoir 56, the fluid 66 inside is forced into the fluid passages 62 and ultimately out through the nodule support surface 10 through the fluid ports 64 into the child's mouth (see arrows indicating fluid flow path). The fluid 66 can be a fluoride solution which, when applied to the teeth, helps prevent tooth decay, or can be warm or chilled water for soothing the child's tender gums during the teething stage. Securing the fluid 66 inside the reservoir 56 is an independent locking end cap 68 or an end plug 70, which is attached to the end of handle member 4.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

We claim:

1. An oral hygiene device for infants and young children comprising:

a handle member symmetrically oriented about a handle axis with the handle member having a first end and a second end, and a head member having a generally oval shape, including a forward end and a back end and a nodule support surface, such head member and said nodule support surface extending longitudinally in a direction generally in alignment with said handle axis, and a plurality of nodules of varying heights and thicknesses supported by and extending from said nodule support surface, and a resilient abutment flange normally oriented relative to the handle axis fixedly mounted to said first end at an interface of the handle member and said head member, and said forward end of said head member having a shape that is slightly elongated and tapered relative to the shape of said back end of said head member.

2. The oral hygiene device of claim 1 wherein said handle member is collapsible and expandable along said handle axis.

3. The oral hygiene device of claim 1 wherein said plurality of nodules are disposed linearly upon said nodule support surface in a direction generally in alignment with said handle axis and comprise nodules of varying heights that are arranged on said nodule support surface according to an alternating sequence.

4. The oral hygiene device of claim 1 wherein said nodules are comprised of rubber.

5. The oral hygiene device of claim 1 wherein said nodules are comprised of a synthetic material.

6. The oral hygiene device of claim 1 wherein said head member, includes an interior section and an outer surface and a fluid reservoir defined within a portion of the interior section proximate to said first end, said fluid reservoir having a fill cap means enabling replenishment of the fluid reservoir and one or more fluid passages extending from said fluid reservoir through the interior section of said head member to a plurality of corresponding fluid ports formed in the outer surface of said head member for communicating a fluid in said fluid reservoir to one or more of said fluid ports.

7. The oral hygiene device of claim 6 wherein said fill cap means is incorporated as a part of said handle member adapted to be secured to said second end in locking engagement therewith.

8. An oral hygiene device for infants and young children comprising:

a handle member symmetrically oriented around a principal axis, said handle member having an annular shape and a first end and a second end, a head member having a generally oval shape, including a forward end and a back end and a nodule support, said head member and said nodule support surface extending longitudinally in a direction generally in alignment with said principal axis, and a plurality of nodules of varying heights and thicknesses supported by and extending from said nodule support surface, and a resilient abutment flange normally oriented relative to the principal axis fixedly mounted to said first end at an interface of the handle member and said head member, and said forward end of said head member having a shape that is slightly elongated and tapered relative to the shape of said back end of said head member.

9. The oral hygiene device of claim 8, wherein said plurality of nodules are disposed linearly upon said nodule support surface in a direction generally in alignment with said principal axis and include nodules of varying heights that are arranged on said nodule support surface according to an alternating sequence.

10. The oral hygiene device of claim 8 wherein said head member includes an interior section and an outer surface, and a fluid reservoir defined within a portion of the interior section proximate to said first end, said fluid reservoir having a fill cap means enabling replenishment of the fluid reservoir and one or more fluid passages extending from said fluid reservoir through the interior section of said head member to a plurality of corresponding fluid ports formed in the outer surface of said head member for communicating a fluid in said fluid reservoir to one or more of said fluid ports.

11. The oral hygiene device of claim 10 wherein said fill cap means is incorporated as a part of said handle member adapted to be secured to said second end in locking engagement therewith.

12. An oral hygiene device for infants and young children comprising:

a handle member symmetrically oriented about a handle axis with the handle member having a first end and a second end, and a head member having a generally rectangular shape including a forward end, a back end, a top surface, a bottom surface, a first side surface, a second side surface and a front surface, said head member extending longitudinally in a direction generally in alignment with said handle axis and including a plurality of first nodule groupings disposed upon said top surface, said first side surface, said second side surface and said bottom surface in a direction generally in alignment with the longitudinal axis of said head member and a plurality of second nodule groupings disposed upon said front surface in a direction transverse to the orientation of the handle axis, each of said first and second nodule groupings including a plurality of annular projections, and a resilient abutment flange normally oriented relative to the handle axis fixedly mounted to said first end at an interface of the handle member and said head member.

13. The oral hygiene device of claim 12 wherein said top surface and said bottom surface converge to form a narrowing at said forward end.

14. The oral hygiene device of claim 12 wherein said handle member is collapsible and expandable along its handle axis.

15. An oral hygiene device for infants and young children comprising:

a handle member symmetrically oriented around a principal axis, said handle member having an annular shape and a first end and a second end, and a head member having a generally rectangular shape including a forward end, a back end, a top surface, a bottom surface, a first side surface, a second side surface, and a front surface, said head member extending longitudinally in a direction generally in alignment with said principal axis and including a plurality of first nodule groupings disposed upon said top surface, said first side surface, said second side surface and said bottom surface in a direction generally in alignment with the longitudinal axis of said head member and a plurality of second nodule groupings disposed upon said front surface in a direction transverse to the orientation of the principal axis, each of said first and second nodule groupings including a plurality of annular projections, and a resilient abutment flange normally oriented relative to the principal axis fixedly mounted to said first end at an interface of the handle member and said head member.

16. The oral hygiene device of claim 15 wherein said top surface and said bottom surface converge to form a narrowing at said forward end.

17. An oral hygiene device for infants and young children comprising:

a handle member symmetrically oriented about a handle axis with the handle member having a first end and a second end, and a head member having a generally rectangular shape including a forward end, a back end, a top surface, a bottom surface, a first side surface, a second side surface, and a front surface, said head member extending longitudinally in a direction generally in alignment with said handle axis and including a plurality of first nodule groupings upon said top surface, first side surface, second side surface and bottom surface disposed in alignment with the longitudinal axis of said head member and a plurality of second nodule groupings disposed upon said front surface in a direction transverse to the longitudinal axis of said head member, each of said nodule groupings including a plurality of generally rectangular shape annular projections and interspersed between each of said generally rectangular shape projections a shorter inverted V-shape projection, and a resilient abutment flange normally oriented relative to the handle axis fixedly mounted to said first end at an interface of the handle member and said head member.

18. The oral hygiene device of claim 17 wherein said forward end narrows such that said top surface and said bottom surface converge.

19. The oral hygiene device of claim 17 wherein said handle member is collapsible and expandable along its handle axis.

20. An oral hygiene device for infants and young children comprising:

a handle member symmetrically oriented around a principal axis, said handle member having an annular shape and a first end and a second end, and a head member having a generally rectangular shape including a forward end, a back end, a top surface, a bottom surface, a first side surface, a second side surface and a front surface, said head member extending longitudinally in a direction generally in alignment with said principal axis and including a plurality of first nodule groupings upon said top surface, first side surface, second side surface and said bottom surface disposed in alignment with the longitudinal axis of said head member and a plurality of second nodule groupings disposed upon said front surface in a direction transverse to the longitudinal axis of said head member, each of said nodule groupings including a plurality of generally rectangular shape annular projections and interspersed between each of said generally rectangular shape projections a shorter inverted V-shape projection, and a resilient abutment flange normally oriented relative to the principal axis fixedly mounted to said first end at an interface of the handle member and said head member.

* * * * *